US009189981B2

(12) United States Patent
Joo et al.

(10) Patent No.: US 9,189,981 B2
(45) Date of Patent: Nov. 17, 2015

(54) DISPLAY METHOD, FILM AND DISPLAY DEVICE USING MAGNETIC PARTICLES

(71) Applicant: NANOBRICK CO., LTD., Suwon-si (KR)

(72) Inventors: Jae Hyun Joo, Suwon-si (KR); Do Hyun Kim, Suwon-si (KR); Youn Jung Park, Suwon-si (KR); In Sook Lee, Suwon-si (KR)

(73) Assignee: NANOBRICK CO., LTD., Suwon (KR)

( * ) Notice: Subject to any disclaimer, the term of this patent is extended or adjusted under 35 U.S.C. 154(b) by 127 days.

(21) Appl. No.: 13/980,883

(22) PCT Filed: Feb. 7, 2013

(86) PCT No.: PCT/KR2013/000977

§ 371 (c)(1),
(2) Date: Jul. 21, 2013

(87) PCT Pub. No.: WO2013/119046

PCT Pub. Date: Aug. 15, 2013

(65) Prior Publication Data

US 2014/0109446 A1 Apr. 24, 2014

(30) Foreign Application Priority Data

Feb. 7, 2012 (KR) ..... 10-2012-0012401
Aug. 16, 2012 (KR) ..... 10-2012-0089732

(51) Int. Cl.

| | |
|---|---|
| ***A47F 11/06*** | (2006.01) |
| ***B44F 1/00*** | (2006.01) |
| ***G09F 19/12*** | (2006.01) |
| ***G09F 19/02*** | (2006.01) |
| ***G09F 9/37*** | (2006.01) |
| ***B43L 1/04*** | (2006.01) |
| ***B43L 1/10*** | (2006.01) |
| ***B43L 1/00*** | (2006.01) |

(52) U.S. Cl.
CPC ..... *G09F 19/02* (2013.01); *B43L 1/008* (2013.01); *B43L 1/045* (2013.01); *B43L 1/10* (2013.01); *G09F 9/375* (2013.01)

(58) Field of Classification Search
CPC ..... B43L 1/008
USPC ..... 434/409
See application file for complete search history.

(56) References Cited

U.S. PATENT DOCUMENTS 4,232,084 A * 11/1980 Tate ..... 428/321.5
5,057,363 A * 10/1991 Nakanishi ..... 428/321.5

(Continued)

FOREIGN PATENT DOCUMENTS

KR 10-1998-0011253 A 4/1998
KR 10-1999-0087860 A 12/1999

(Continued)

OTHER PUBLICATIONS

International Search Report for PCT Application No. PCT/KR2013/000977, Korean Intellectual Property Office, Jun. 10, 2013.

*Primary Examiner* — Joanne Silbermann

(57) ABSTRACT

A display device and a display method using magnetic particles are disclosed. The display method includes: applying a first magnetic field to a plurality of particles in a state where the plurality of particles having a magnetic property and a certain color are dispersed in a solvent so that the plurality of particles are aligned in a direction parallel to a direction of the first magnetic field, and thus a plurality of particle chains are formed; and applying a second magnetic field to at least a part of the formed plurality of particle chains so that at least a part of the plurality of particle chains moves in a direction close to a display surface in an area to which the second magnetic field is applied, and thus the certain color is displayed on the display surface.

15 Claims, 17 Drawing Sheets

(a)

(b)

(56) References Cited

U.S. PATENT DOCUMENTS

| | | | | |
|---|---|---|---|---|
| 6,705,874 | B1 * | 3/2004 | Koyama | 434/409 |
| 6,943,772 | B2 * | 9/2005 | Yasuda | 345/107 |
| 2007/0103428 | A1 * | 5/2007 | Kazmaier et al. | 345/107 |

FOREIGN PATENT DOCUMENTS

| | | | |
|---|---|---|---|
| KR | 10-2001-0070200 | A | 7/2001 |
| KR | 10-2006-0107747 | A | 10/2006 |

* cited by examiner (a)

(b)

(c)

(a)

(b)

(c)

(a)

(b)

(c)

(a)

(b)

(c)

(a)

(b)

(a)

(b)

(a)

(b)

(a)

(b)

(a)

(b)

(a)

(b)

(a)

(b)

DISPLAY METHOD, FILM AND DISPLAY DEVICE USING MAGNETIC PARTICLES

PRIORITY

The present application claims priority under 35 U.S.C. §371 to PCT Application PCT/KR2013/000977, filed on Feb. 7, 2013, which claims priority to Korean Patent Application No. 10-2012-0012401, filed on Feb. 7, 2012, and to Korean Patent Application No. 10-2012-0089732, filed on Aug. 16, 2012, the disclosures of which are hereby incorporated by reference in their entireties.

BACKGROUND OF THE INVENTION

1. Field of the Invention

The present invention relates generally to a display method, a film and a display device using magnetic particles, and specifically to a display method, a film and a display device using magnetic particles by: applying a first magnetic field to particles having a magnetic property dispersed in a solvent so that particles are aligned in a direction parallel to a direction of the first magnetic field, and thus particle chains are formed; applying a second magnetic field to the formed particle chains so that the particle chains move in a direction close to a display surface; and changing a strength or a direction of the second magnetic field or applying a third magnetic field in an opposite direction of the second magnetic field so that the particle chains move away from the display surface, and thus the intensity and the color of the information displayed through the display surface is adjusted.

2. Description of the Prior Art

A magnetic board using magnetic powder or a magnetic field is widely used as a writing tool for child since it has no color or no waste. As an example of the conventional art, it has been disclosed that magnetic particles are dispersed in a colored fluid and are filled in a structural body having barriers, and then a magnetic field is partially applied using a magnetic pen on the top of the structural body so that the magnetic particles move to display certain information, or a magnetic field in an opposite direction is applied using a magnetic plate movable in a lower portion of the structural body so that the information displayed by the magnetic particles are entirely erased.

FIG. 1 is a diagram illustrating an example of a device for displaying according to the conventional art. With reference to FIG. 1, the color of particles 110 may be displayed by applying a magnetic field with a magnet 130 positioned on the top of the device for displaying and moving the particles 110 in a solvent 120 to the upper portion (that is, in case of writing), and the color of particles 110 may not be displayed by entirely applying a magnetic field in an opposite direction with a magnet 140 positioned on the lower portion of the device for displaying and movable from side to side and moving the particles 110 in a solvent 120 to the lower portion (that is, in case of erasing).

However, according to the conventional art, it is difficult to partially erase displayed information, adjust intensity or color of the displayed information, and manufacture the device for displaying to be thin and flexible.

Accordingly, the inventors of the present invention have developed a display method, a film, and a display device using magnetic particles by applying a first magnetic field to magnetic particles dispersed in a solvent so that the particles are aligned in a direction parallel to a direction of the first magnetic field to form particle chains, applying a second magnetic field to the formed particle chains so that the particle chains move in a direction close to the display surface, and changing an intensity or direction of the second magnetic field or applying a third magnetic field in an opposite direction to the second magnetic field so that the particle chains move away from the display surface to display the color of the particles through the display surface, and the inventors have conceived various modifications using the same.

SUMMARY OF THE INVENTION

The purpose of the present invention is to solve all the problems described above.

In addition, an aspect of the invention is to provide a display method, a film, and a display device, which apply a first magnetic field to magnetic particles dispersed in a solvent so that the particles are aligned in a direction parallel to a direction of the first magnetic field to form particle chains, apply a second magnetic field to the formed particle chains so that the particle chains move in a direction close to the display surface, and change an intensity or direction of the second magnetic field or apply a third magnetic field in an opposite direction to the second magnetic field so that the particle chains move away from the display surface to adjust the displayed state variously.

A display method using magnetic particles includes steps of: (a) applying a first magnetic field to a plurality of particles in a state where the plurality of particles having a magnetic property and a certain color are dispersed in a solvent so that the plurality of particles are aligned in a direction parallel to a direction of the first magnetic field, and thus a plurality of particle chains are formed; and (b) applying a second magnetic field to at least a part of the formed plurality of particle chains so that at least a part of the plurality of particle chains moves in a direction close to a display surface in an area to which the second magnetic field is applied, and thus the certain color is displayed on the display surface.

In step (a), each of the plurality of particles may rotate or move so that a magnetization direction of the plurality of particles is identical to a direction of the first magnetic field; and the plurality of particles may be aligned in a direction parallel to the direction of the first magnetic field by interaction among the plurality of particles.

The plurality of particles may comprise a ferromagnetic material; and in step (a), although the first magnetic field is blocked, the plurality of particle chains may be maintained by residual magnetic polarity formed in each of the plurality of particles due to the ferromagnetic material.

In step (b), at least one of a distance between the display surface and the particle chains, which move in the direction close to the display surface in the area to which the second magnetic field is applied, and an angle between the display surface and the particle chains may be adjusted by adjusting at least one of a strength, a direction, an application time, an application speed, and a pattern of lines of magnetic force of the second magnetic field, and thus an intensity of the certain color displayed on the display surface may be adjusted.

The plurality of particles may include at least two kinds of particles with different saturation magnetization values and different colors; in step (b), kinds of the particle chains, which move in the direction close to the display surface in the area to which the second magnetic field is applied, may vary according to the strength of the second magnetic field, and thus colors displayed on the display surface may vary.

At least two cells each including at least two kinds of particles with different colors may be vertically stacked so that kinds of the particle chains, which move in the direction close to the display surface, may vary according to strength of the second magnetic field applied to the at least two cells, and thus colors displayed on the display surface may vary.

At least two cells each including at least two kinds of particles with different colors may be horizontally arranged, and the second magnetic field may be independently applied to the at least two cells so that kinds of the particle chains, which move in the direction close to the display surface, may be adjusted independently in each of the at least two cells.

Transfer resistance of the plurality of particle chains in the solvent may be adjusted so that after the second magnetic field is blocked in step (b), an arrangement state of the particle chains, which move in the direction close to the display surface in the area to which the second magnetic field is applied, may be maintained in a certain range for a certain period of time or more.

Transfer resistance of the plurality of particle chains in the solvent may be adjusted by adjusting at least one of viscosity of the solvent, specific gravity of the solvent, specific gravity of the particles, or adding an additive to the solvent.

Step (c1) may be further comprised: At least one of a direction, a strength, an application time, an application speed, and a pattern of lines of magnetic force of the second magnetic field on the display surface may be changed so that the particle chains, which move in the direction close to the display surface in the area to which the second magnetic field is applied in step (b), may be irregularly arranged, and thus an intensity of the certain color may be decreased only in an area where the change is performed in the display surface.

Step (c2) may be further comprised: A third magnetic field may be applied so that the plurality of particle chains may move in a direction away from the display surface, and thus an intensity of the certain color displayed in the display surface may be decreased.

The plurality of particles and the solvent may be encapsulated by a light permeable medium and processed into a film shape.

The plurality of particles may have electric charges with the same polarity; and in step (b), an electric field may be further applied so that at least a part of the plurality of particle chains moves in a direction close to the display surface in an area to which the electric field is applied or in a direction away from the display surface, and thus an intensity of the certain color displayed on the display surface is adjusted.

In step (b), the intensity of the certain color displayed on the display surface may be adjusted by adjusting a pattern of the electric field with reference to a signal input from a touch sensor provided on the display surface.

Step (d) may be further comprised: Information on the certain color displayed on the display surface may be converted into information of computer-readable form by using an optical scanning technique.

In addition, a display method using magnetic particles according to an embodiment of the present invention includes: (a) in a state where a plurality of particles having a ferromagnetic material and a certain color are dispersed in a solvent, aligning the plurality of particles by residual magnetic polarity formed in each of the plurality of particles by the ferromagnetic material so that a plurality of particle chains are formed; and (b) applying a second magnetic field to at least a part of the formed plurality of particle chains so that at least a part of the plurality of particle chains moves in a direction close to the display surface in an area to which the second magnetic field is applied, and thus the certain color is displayed on the display surface.

In addition, a display device using magnetic particles according to an embodiment of the present invention includes: a plurality of particles having a magnetic property and a certain color; a solvent in which the plurality of particles are dispersed; a first magnetic field application unit that applies a first magnetic field to the particles and the solvent; and a second magnetic field application unit that applies a second magnetic field to the particles and the solvent, wherein the first magnetic field application unit applies the first magnetic field to the plurality of particles in a state where the plurality of particles are dispersed in the solvent so that the plurality of particles are aligned in a direction parallel to a direction of the first magnetic field and the plurality of particle chains are formed, and the second magnetic field application unit applies a second magnetic field to at least a part of the formed plurality of particle chains so that at least a part of the plurality of particle chains moves in a direction close to a display surface in an area to which the second magnetic field is applied, and thus the certain color is displayed on the display surface.

The first magnetic field application unit may rotate or move each of the plurality of particles so that a magnetization direction of the plurality of particles is identical to a direction of the first magnetic field, and the plurality of particles may be aligned in a direction parallel to the direction of the first magnetic field by interaction among the plurality of particles.

The plurality of particles may comprise a ferromagnetic material, and if the first magnetic field is blocked, the plurality of particle chains may be maintained due to residual magnetic polarity formed in each of the plurality of particles by the ferromagnetic material.

The second magnetic field application unit may adjust at least one of a distance between the display surface and the particle chains, which move in the direction close to the display surface in the area to which the second magnetic field is applied, and an angle between the display surface and the particle chains by adjusting at least one of a strength, a direction, an application time, an application speed, and a pattern of lines of magnetic force of the second magnetic field, and thus may adjust an intensity of the certain color displayed on the display surface.

The plurality of particles may include at least two kinds of particles with different saturation magnetization values and different colors, and kinds of the particle chains, which move in the direction close to the display surface in the area to which the second magnetic field is applied, may vary according to the strength of the second magnetic field, and thus colors displayed on the display surface may vary.

At least two cells each including at least two kinds of particles with different colors may be vertically stacked, kinds of the particle chains, which move in the direction close to the display surface, vary according to the strength of the second magnetic field applied to the two cells, and thus colors displayed on the display surface may vary.

At least two cells each including at least two kinds of particles with different colors may be horizontally arranged, and the second magnetic field application unit independently may apply the second magnetic field to the at least two cells so that kinds of the particle chains, which move in the direction close to the display surface, are adjusted independently in each of the at least two cells.

Transfer resistance of the plurality of particle chains in the solvent may be adjusted so that after the second magnetic field is blocked, an arrangement state of the particle chains, which move in the direction close to the display surface in the area to which the second magnetic field is applied, may be maintained in a certain range for a certain period of time or more.

Transfer resistance of the plurality of particle chains in the solvent may be adjusted by adjusting at least one of a viscosity of the solvent, specific gravity of the solvent, specific gravity of the particles, or adding an additive to the solvent.

The second magnetic field application unit may change at least one of a direction, a strength, an application time, an application speed, and a pattern of of lines of magnetic force of the second magnetic field on the display surface so that the particle chains, which move in the direction close to the display surface in the area to which the second magnetic field is applied, may be irregularly arranged, and thus an intensity of the certain color may be decreased only in an area where the change is performed in the display surface.

A third magnetic field application unit may be further included, which may apply a third magnetic field so that the plurality of particle chains moves in a direction away from the display surface, and thus the intensity of the certain color displayed in the display surface may be decreased.

The plurality of particles and the solvent may be encapsulated by a light permeable medium and processed into a film shape.

An electric field application unit may be further included, which may apply an electric field so that at least a part of the plurality of particle chains may move in a direction close to the display surface in an area to which the electric field is applied or in a direction away from the display surface so that the intensity of the certain color displayed on the display surface may be adjusted, and thus the plurality of particles may have electric charges with the same polarity on a surface.

The electric field application unit may adjust the intensity of the certain color displayed on the display surface by adjusting a pattern of the electric field with reference to a signal input from a touch sensor provided on the display surface.

An information converting unit may be further included, which may convert information on the certain color displayed on the display surface into information of computer-readable form by using an optical scanning technique.

The second magnetic field application unit may include a magnetic field generating unit that generates the second magnetic field, and a magnetic field blocking unit that blocks the second magnetic field generated from the magnetic field generating unit from being applied to an area other than an area where target particle chains exist.

The second magnetic field application unit may adjust at least one of a strength or a direction of the second magnetic field generated from the magnetic field generating unit.

The display surface may be configured in a form of a scroll made of flexible materials, the third magnetic field application unit may be disposed in a certain position on the display surface, and if the display surface is rolled or unrolled, an intensity of the certain color displayed in an area positioned in a certain distance from the third magnetic field application unit in the display surface may be decreased.

In addition, a display device using magnetic particles according to an embodiment of the present invention includes: a plurality of particles including a ferromagnetic material and a certain color; a solvent in which the plurality of particles are dispersed; and a second magnetic field application unit that applies a second magnetic field to the particles and the solvent, wherein a plurality of particles in a state where the plurality of particles are dispersed in a solvent is aligned by residual magnetic polarity formed in each of the plurality of particles due to the ferromagnetic material so that a plurality of particle chains are formed, and the second magnetic field application unit applies a second magnetic field to at least a part of the formed plurality of particle chains so that at least a part of the plurality of particle chains moves in a direction close to the display surface in an area to which the second magnetic field is applied, and thus the certain color is displayed on the display surface.

In addition, a film using magnetic particles according to an embodiment of the present invention includes: a plurality of particles having a magnetic property and a certain color; and a solvent in which the plurality of particles are dispersed, wherein, if the first magnetic field is applied to the plurality of particles in a state where the plurality of particles are dispersed in the solvent, the plurality of particles are aligned in a direction parallel to a direction of the first magnetic field and the plurality of particle chains are formed, and if a second magnetic field is applied to at least a part of the formed plurality of particle chains, at least a part of the plurality of particle chains moves in a direction close to a display surface in an area to which the second magnetic field is applied, and thus the certain color is displayed on the display surface.

If at least one of a direction and a strength of the second magnetic field is changed, the particle chains, which move to the direction close to the display surface in the area to which the second magnetic field is applied, may be irregularly arranged, and thus an intensity of the certain color displayed on the display surface may be decreased.

If a third magnetic field in an opposite direction of the second magnetic field is applied, the plurality of particle chains may move in a direction away from the display surface, and thus an intensity of the color displayed on the display surface may be decreased.

In addition, a film using magnetic particles according to an embodiment of the present invention includes: a plurality of particles having a ferromagnetic material and a certain color; and a solvent in which the plurality of particles are dispersed, wherein the plurality of particles in a state where the plurality of particles are dispersed in a solvent are aligned by residual magnetic polarity formed in each of the plurality of particles due to the ferromagnetic material so that a plurality of particle chains are formed, and if a second magnetic field is applied to at least a part of the formed plurality of particle chains, at least a part of the plurality of particle chains moves in a direction close to the display surface in an area to which the second magnetic field is applied, and thus the certain color is displayed on the display surface.

The present invention configured as described above may achieve the effect of partially writing or erasing the desired information by using a magnetic field application device such as a magnetic pen.

In addition, the present invention may achieve the effect of adjusting the intensity or the color of information displayed on the device for displaying.

BRIEF DESCRIPTION OF THE DRAWINGS

The above and other objects, features and advantages of the present invention will be more apparent from the following detailed description taken in conjunction with the accompanying drawings, in which:

FIGS. 2A to 5C are diagrams illustrating exemplary configurations and operating principles of a device for displaying according to an embodiment of the present invention;

FIGS. 6A to 7B are diagrams illustrating exemplary configurations for adjusting light intensity according to an embodiment of the present invention;

FIGS. 8A to 10B are diagrams illustrating exemplary configurations for displaying various colors according to an embodiment of the present invention;

FIGS. 11A to 13B are diagrams illustrating exemplary configurations of the device for displaying in a stacked structure according to an embodiment of the present invention;

DETAILED DESCRIPTION OF THE EXEMPLARY EMBODIMENTS

Figure 1:
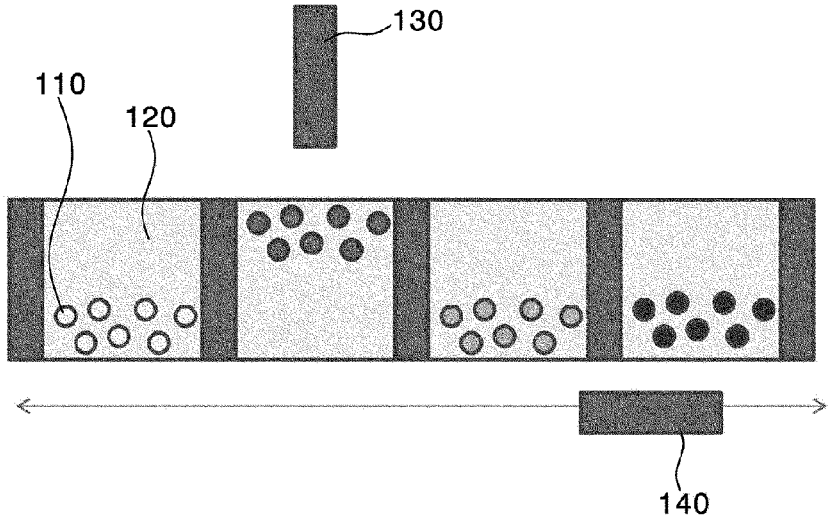
FIG. 1 (Prior Art)
FIG. 1 is a diagram illustrating an example of a device for displaying according to the conventional art.
Figure 2:
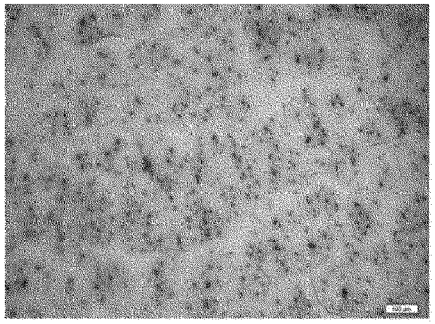
Figure 2:
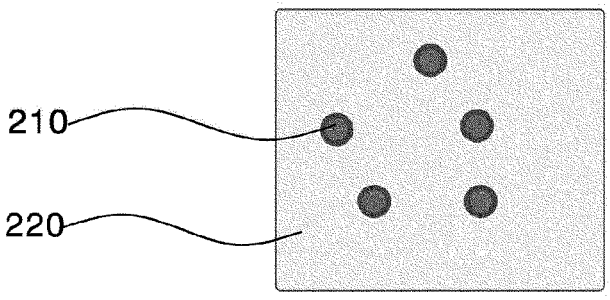
Figure 2:
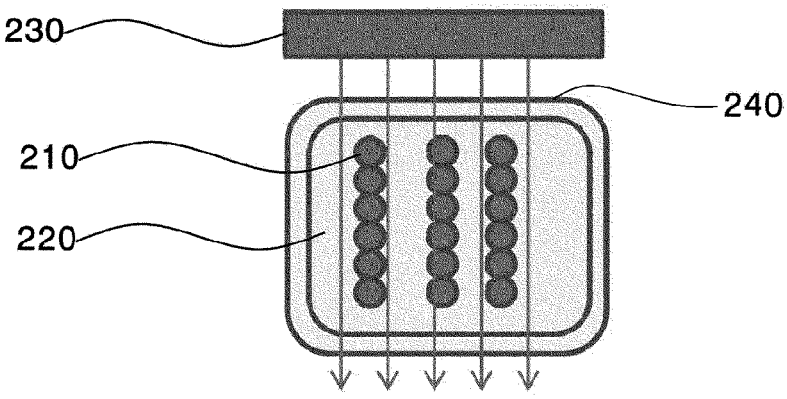
Figure 3:
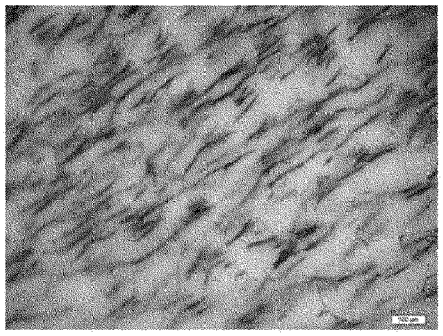
Figure 3:
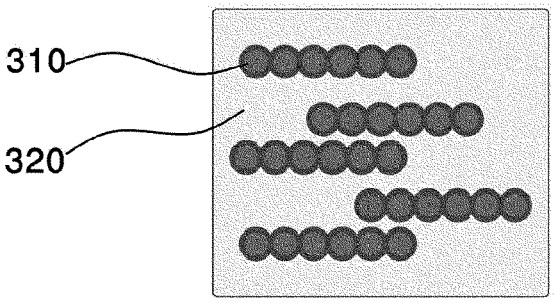
Figure 3:
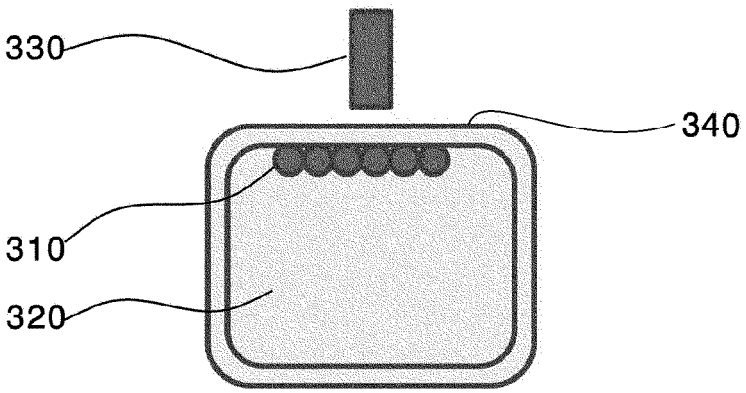
Figure 4:
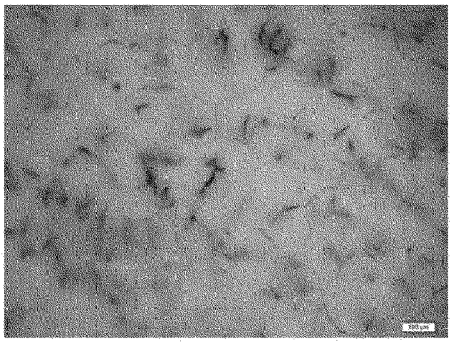
Figure 4:
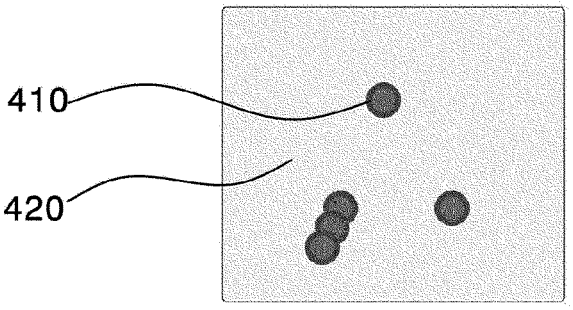
Figure 4:
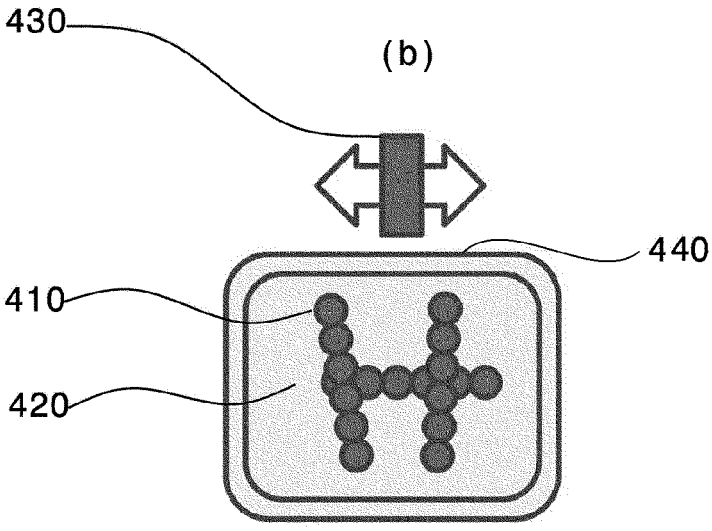
Figure 5:
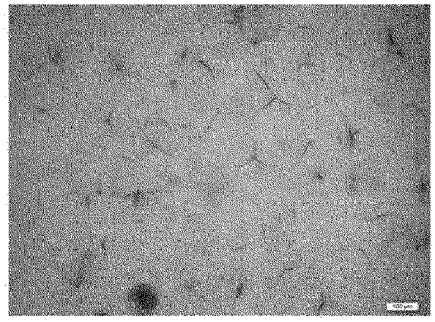
Figure 5:
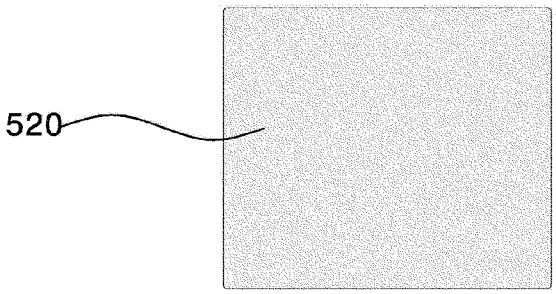
Figure 5:
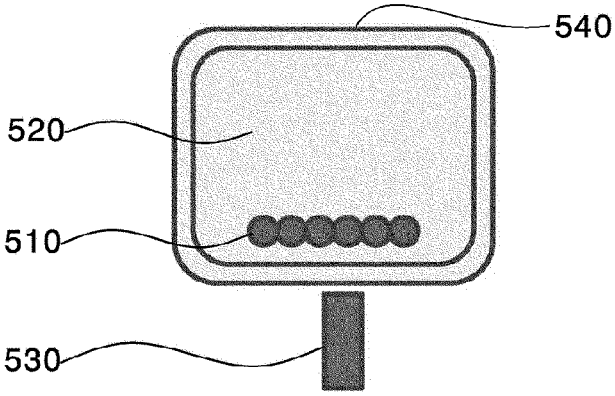
Figure 6:
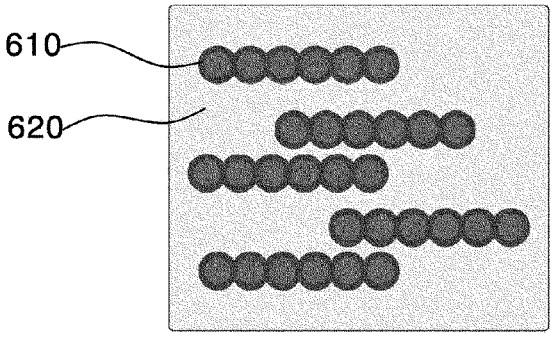
Figure 6:
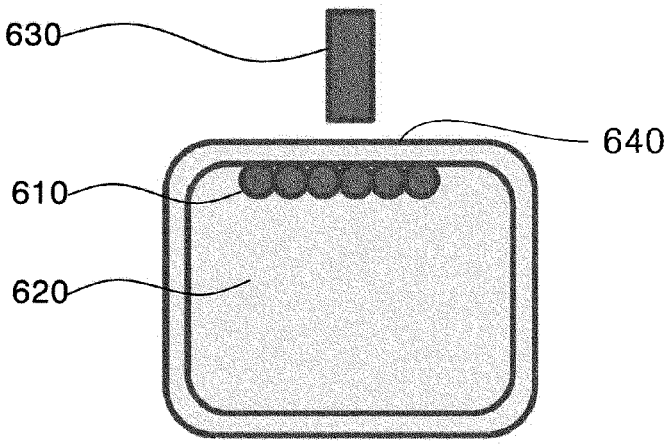
Figure 7:
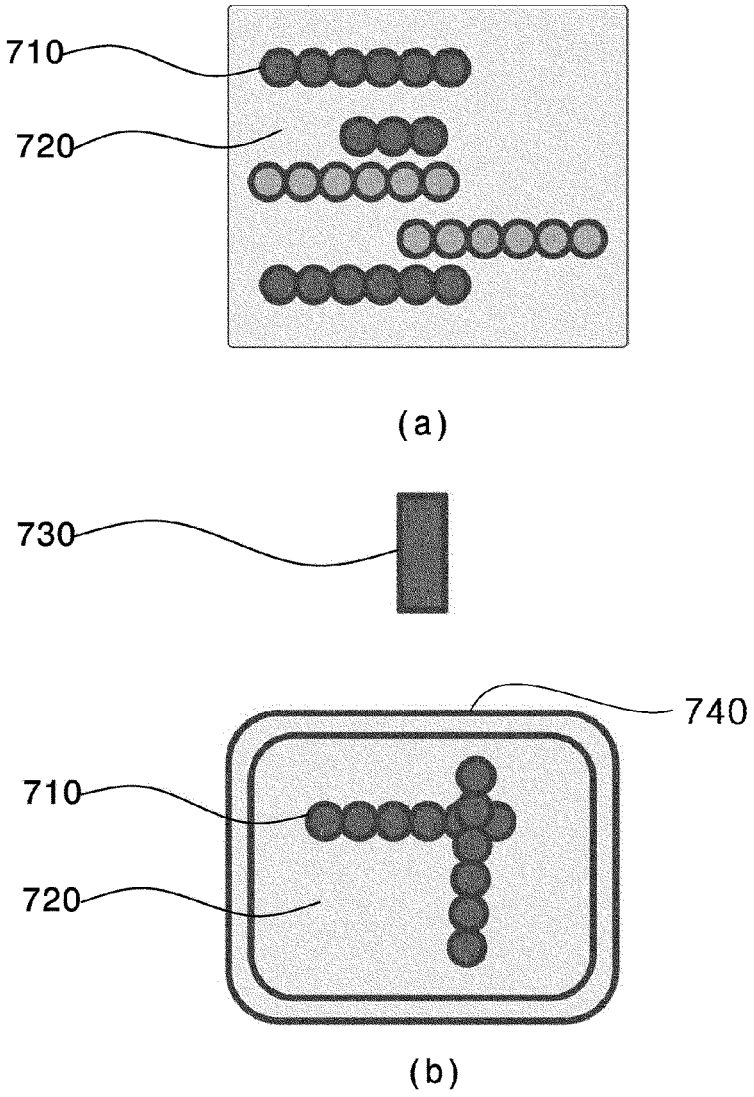
Figure 8:
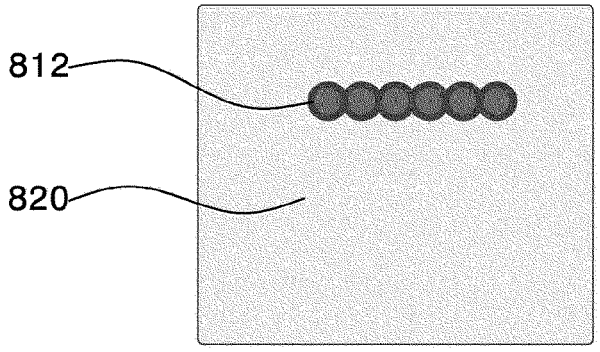
Figure 8:
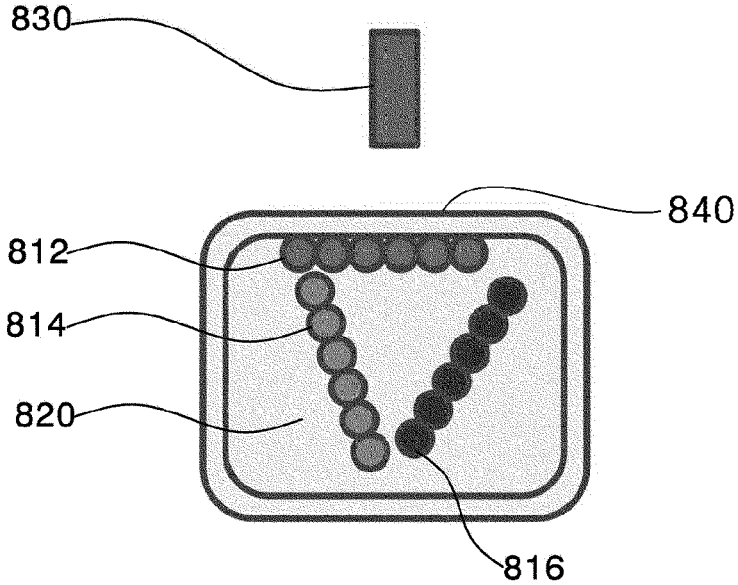
Figure 9:
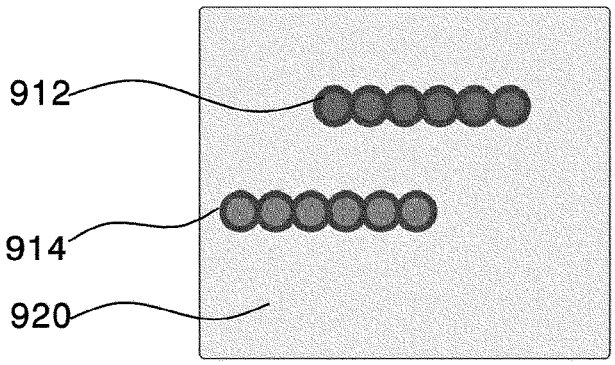
Figure 9:
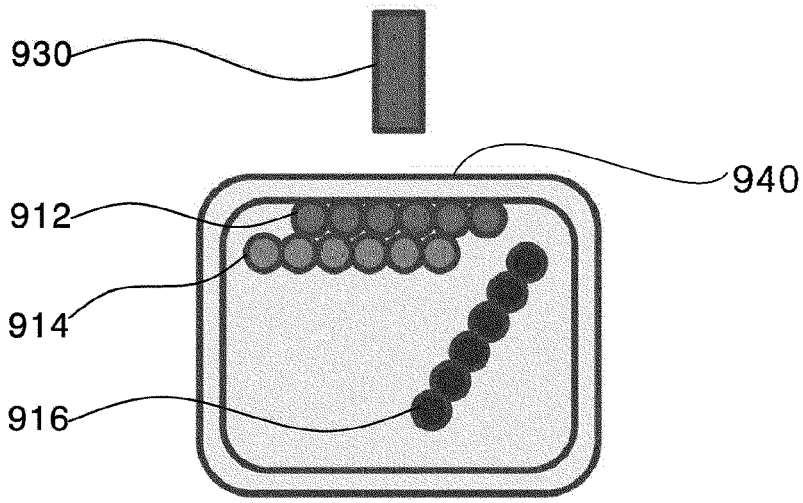
Figure 10:
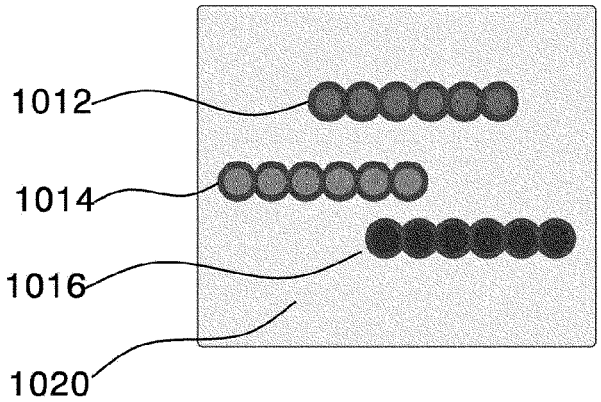
Figure 10:
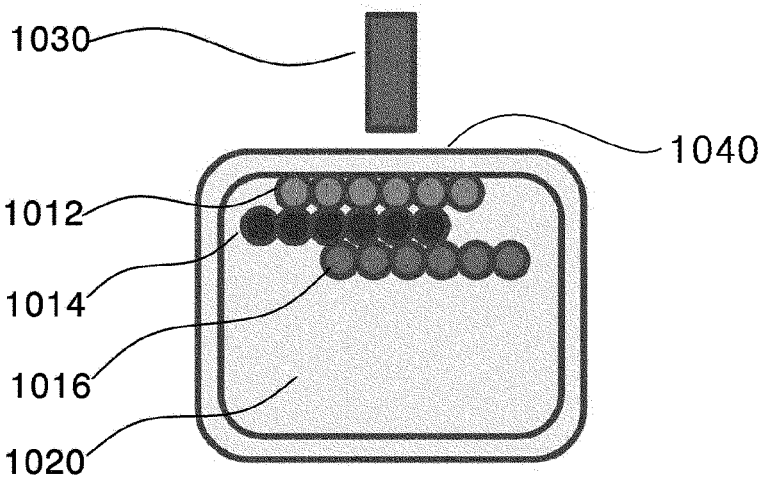
Figure 11:
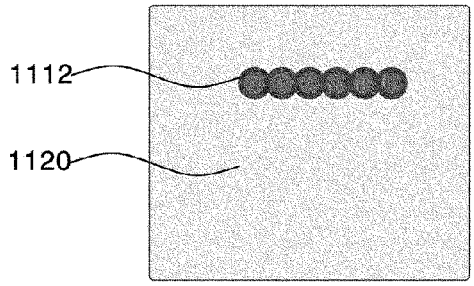
Figure 11:
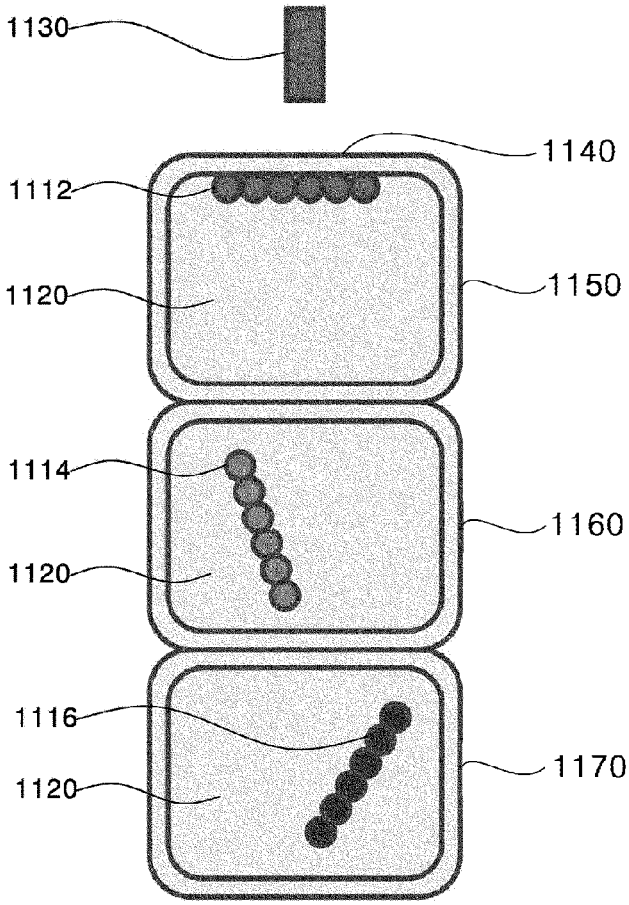
Figure 12:
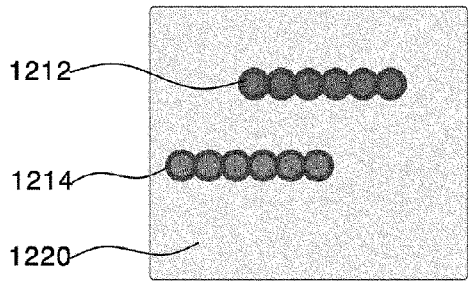
Figure 12:
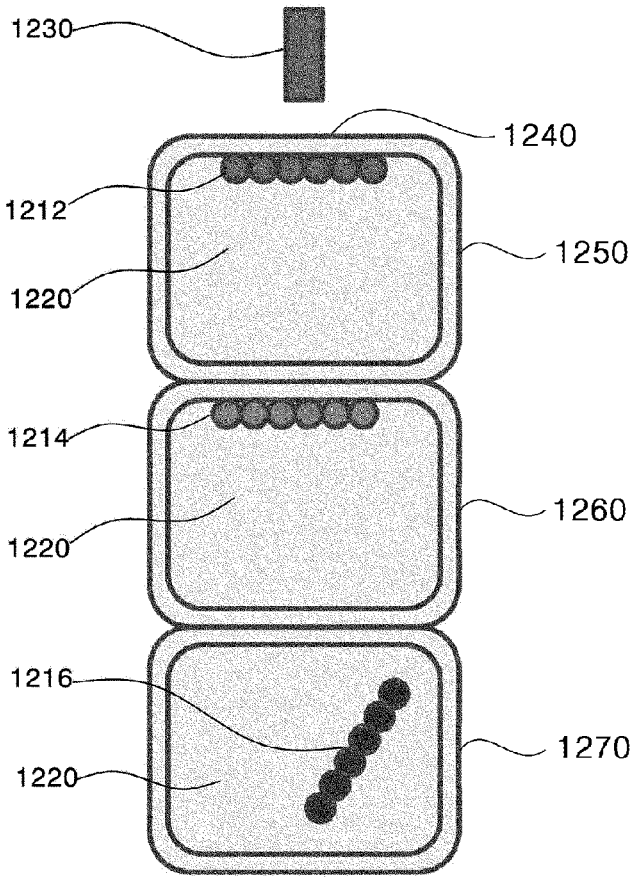
Figure 13:
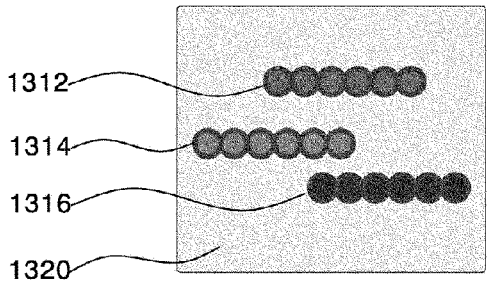
Figure 13:
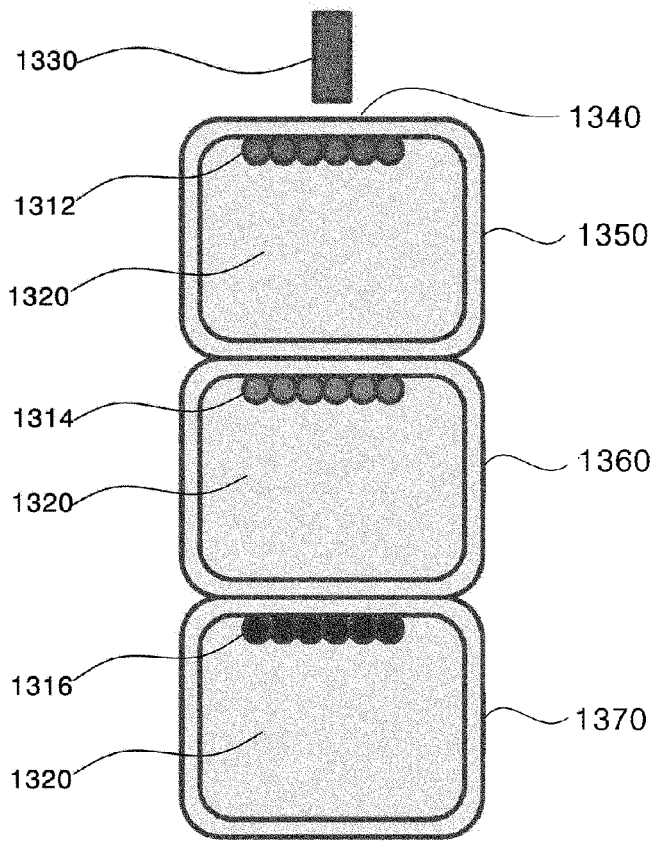
Figure 14:
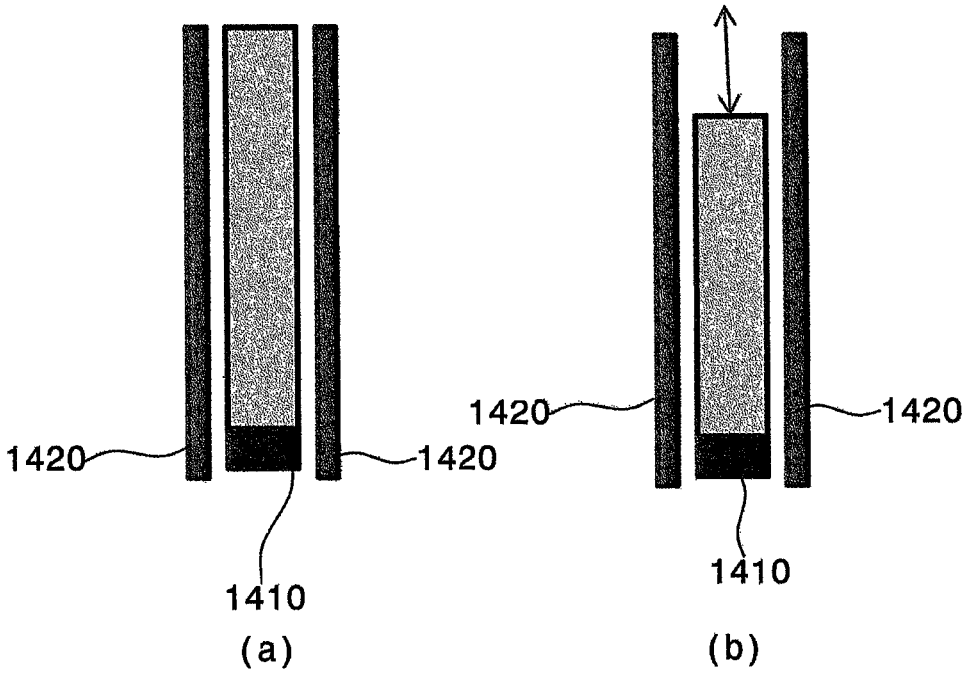
FIGS. 14A and 14B are diagrams illustrating exemplary configurations of a second magnetic field application unit according to an embodiment of the present invention.

The following detailed descriptions according to the present invention will be made with reference to the accompanied drawings illustrating certain exemplary embodiments by which the present invention can be practiced. The embodiments will be described in detail so that the present invention can be practiced by those skilled in the art. Various embodiments are different from each other, but it should be understood that the embodiments do not have to be mutually exclusive. For example, a specific form, structure, or characteristic according to an embodiment may be implemented by another embodiment without departing from the sprit or scope of the present invention. In addition, it should be understood that the position or disposition of each component in each embodiment can be changed without departing from the sprit or scope of the present invention. Therefore, the detailed description described below is not intended to limit the present invention, but the scope of the present invention, if explained properly, would be limited by the accompanied claims and the equivalents thereof. Similar reference numerals in the drawings denote the same or similar functions in various aspects.

Herein, in order to easily practice the present invention by those skilled in the art, configurations of the present invention are described in detail with reference to the accompanied drawings.

Configurations of Particles and Solvents

First, configurations of particles and solvents included in a device for displaying are described in detail as follows.

According to an embodiment of the present invention, the particles may have magnetism so that the particles can rotate or move by receiving magnetic force from a magnetic field, and magnetic materials such as nickel (Ni), iron (Fe), or cobalt (Co) may be included in the particles.

In addition, according to an embodiment of the present invention, the particles may include a material that comes to have magnetism, that is, be magnetized, by being applied with a magnetic field. Especially, according to an embodiment of the present invention, ferromagnetic materials, in which magnetization occurs when an external magnetic field is applied and a magnetized state is maintained by remnant magnetization even when the external magnetic field is blocked, can be used so that particle chains, which are formed with particles aligned as a magnetic field is applied, can be maintained after the magnetic field is blocked. In addition, according to an embodiment of the present invention, the device for displaying may include two or more kinds of particles having different saturation magnetization values.

In addition, according to an embodiment of the present invention, surfaces of the particles can be laminated with a material with a different specific gravity from the corresponding particles, a material with a different specific gravity from the corresponding particles may be mixed into the solvent, or a surface treatment can be performed on the particles so that the particles do not precipitate in a solvent.

In addition, according to an embodiment of the present invention, the particles may be configured to reflect light of a specific wavelength, that is, to have a specific color. To be more specific, the particles according to the present invention may have a specific color by adjusting an oxidation number or laminating an inorganic pigment, a pigment, or the like. For example, as an inorganic pigment laminated on the particles according to the present invention, Zn, Pb, Ti, Cd, Fe, As, Co, Mg, Al, or the like that includes a chromophore may be used in a form of an oxide, a sulfide, and a lactate; and as a dye laminated on the particles according to the present invention, a fluorescent dye, an acid dye, a basic dye, a mordant dye, a sulfide dye, a vat dye, a disperse dye, reactive dye, or the like can be used. As such, when the particles according to the present invention include fluorescent materials, phosphorescent materials, or luminous materials, information can be displayed effectively in a dark environment, for example, at night. For example, the color of the particles according to an embodiment of the present invention may be black.

In addition, the particles according to an embodiment of the present invention may include a material having a structural color by a photonic crystal. To be more specific, a material expressing a structural color by a photonic crystal on which magnetic particles are laminated or a material including magnetic particles may be used as the particles, or a mixture of magnetic particles and particles having a structural color may be used. Since particles having a photonic crystal structure may express different structural colors depending on a viewing angle, photonic crystal particles may move by the arrangement of the magnetic particles as the magnetic field is applied, and thus different structural colors may be expressed according to the magnetic property.

In addition, according to an embodiment of the present invention, silica, polymers, polymer monomers, or the like can be laminated on surfaces of the particles so that the particles have higher dispersibility and stability in a solvent.

Meanwhile, diameters of the particles according to the present invention may be tens of nanometers to tens of micrometers, or may be preferably 3 μm or less, but the diameters are not limited thereto. In addition, the particles according to the present invention may have globular shapes or ellipsoid shapes.

In addition, the configuration of a solvent included in the device for displaying according to the present invention is described in detail as follows.

According to an embodiment of the present invention, the solvent 220, 320, 420, 520, 620, 720, 820, 920, 1020, 1120, 1220, and 1320 (See FIGS. 2B to 14B) may be configured with a material having a similar specific gravity with the particles so that the particles are uniformly dispersed, and configured with a material that is appropriate for the particles to be stably dispersed in the solvent. For example, the solvent may include halogen carbon oil, dimethyl silicon oil, or the like that has a low dielectric constant.

In addition, according to an embodiment of the present invention, the solvent may be configured to reflect light of a specific wavelength, that is, to have a specific color. To be more specific, the solvent according to the present invention may include a material having an inorganic pigment or dye, or a material having a structural color according to a photonic crystal. For example, the color of the solvent may be white.

In addition, according to an embodiment of the present invention, the magnetic particles may be uniformly dispersed in a fat-soluble solvent, and thus the magnetic particles can be prevented from agglomerating together or attaching to inner walls of a capsule in the encapsulation process.

In addition, according to an embodiment of the present invention, the solvent may include titanium oxide ($TiO_x$).

However, the configurations of the particles and the solvent according to the present invention are not limited by the above description, and it should be understood that the configuration can be properly modified in the scope in which the object of the present invention can be achieved.

Subsequently, the configuration in which the particles and the solvent included in the device for displaying according to the present invention are encapsulated or partitioned are described in detail as follows.

According to an embodiment of the present invention, the particles are encapsulated into a plurality of capsules composed of a light permeable material in a state where the particles are dispersed in the solvent. According to an embodiment of the present invention, by encapsulating the particles and the solvent, the generation of direct interference such as inclusion among capsules different from each other can be prevented, and thus particles included in the device for displaying can be controlled independently from capsule to capsule. As a result, the displayed state can be variously adjusted.

For example, as a material that configures a capsule according to an embodiment of the present invention, gelatin, *acacia*, melamine, urea, protein, polysaccharide, or the like may be used; and a material for fixing a capsule in the device for displaying (that is, a binder) can be used. However, the configuration of the capsule according to the present invention is limited to the examples as listed above; and any material which is light permeable, physically strong, not hard, elastic, not porous, and resistant to external heat and pressure can be used as a material of the capsule according to the present invention.

In addition, according to an embodiment of the present invention, the particles are partitioned in a state where the particles are dispersed in the solvent. According to an embodiment of the present invention, the generation of direct interference such as inclusion between cells different from each other which are partitioned by barriers can be prevented, and thus particles included in the device for displaying can be controlled independently from capsule to capsule.

According to an embodiment of the present invention, capsules including particles and solvents may be manufactured in a film shape by being applied on a flexible and thin substrate. In addition, according to an embodiment of the present invention, a member that is functioning as a cushion may be further included under the film, thereby minimizing the damage of the film when a user performs writing or deleting with respect to the film.

Configuration of Device for Displaying

FIGS. 2A to 5C are diagrams illustrating exemplary configurations and operating principles of a device for displaying according to an embodiment of the present invention. For reference, FIGS. 2A to 5C illustrate any one of a plurality of capsules included in the device for displaying, but the features illustrated in FIGS. 2A to 5A can be applied to other capsules included in the device for displaying in the same manner. In addition, FIGS. 2A to 5A are photographs of the display surface of the device for displaying, FIGS. 2B to 5B are diagrams schematically illustrating the display surface of the device for displaying, and FIGS. 2C to 5C are cross-sectional views of the device for displaying.

First, when a magnetic field is not applied to the device for displaying, the plurality of magnetic particles can be irregularly dispersed in the device for displaying, and in this case, no information is displayed on the display surface 240, 340, 440, and 540. That is, the light that enters the device for displaying is scattered or reflected by the plurality of particles, which are irregularly dispersed in the device for displaying, or the solvent 220, 320, 420, and 520, otherwise passes through the device for displaying.

Subsequently, with reference to FIGS. 2A to 2C, a plurality of magnetic particles in the device for displaying according to an embodiment of the present invention are aligned in a direction parallel to a direction of a first magnetic field applied by a first magnetic field application unit 230, and thus particle chains 210 may be formed.

To be more specific, when the first magnetic field is applied to the device for displaying according to an embodiment of the present invention, each of the plurality of particles can rotate or move so that directions from the S-poles to the N-poles of the plurality of particles are the same as the direction of the first magnetic field. In addition, according to an embodiment of the present invention, when the first magnetic field is applied to the device for displaying, the plurality of particles can be magnetized by the first magnetic field, and each of the plurality of magnetized particles can rotate or move so that their magnetization direction is the same as the direction of the first magnetic field. The N-poles and the S-poles of each of the rotated or moved particles come close to the S-poles and the N-poles of neighboring particles, and thus magnetic attractive forces and repulsive forces are generated among the plurality of particles. Accordingly, the plurality of particles are regularly aligned in a direction parallel to the direction of the first magnetic field, so that particle chains 210 can be formed.

Meanwhile, according to an embodiment of the present invention, when the plurality of particles have residual magnetic polarity like a ferromagnetic material, the plurality of particles can be uniformly arranged due to magnetic attractive/repulsive force among the particles when the applied first magnetic field is blocked. That is, when the plurality of particles have residual magnetic polarity, the particles to which the first magnetic field is applied may be uniformly aligned due to the remanent magnetization phenomenon even when the magnetic field is blocked, and thus a state in which the particle chains 210 are formed may be maintained. Thereafter, as a second magnetic field is partially applied and a third magnetic field in an opposite direction is applied, their position or the direction can be changed, as described below. Accordingly, the displayed state of the device for displaying can be adjusted.

Meanwhile, according to another embodiment of the present invention, even though the first magnetic field is specially applied, if the residual magnetic polarity is formed in each of the plurality of particles including ferromagnetic materials, the plurality of particles are aligned by the residual magnetic polarity formed in each of the plurality of particles, and thus a plurality of particle chains may be formed.

Subsequently, with reference to FIGS. 3A to 3C, as the second magnetic field is partially applied, with respect to the plurality of particle chains 310 in the device for displaying according to an embodiment of the present invention, at least a part of the plurality of particle chains 310 may move in a direction close to the display surface 340 in an area to which the second magnetic field is applied. Accordingly, the color of the particle chains 310 may be displayed through the display surface of the device for displaying.

According to an embodiment of the present invention, a second magnetic field application unit 330 that applies the second magnetic field to the plurality of particle chains 310 may include a special configuration required for partially applying the second magnetic field only to a desired area. A more detailed description with respect to the configuration of the second magnetic field application unit 330 will be made below.

In addition, according to an embodiment of the present invention, transfer resistance of the particle chains 310 in a solvent 320 is adjusted by adjusting a viscosity of the solvent, specific gravities of the particles and the solvent, an additive, and the like, so that a state in which a plurality of magnetic particle chains are moved or arranged by the second magnetic field can be maintained as they are for a certain period of time or more even when the second magnetic field applied to the device for displaying is blocked. To be more specific, the configuration of adjusting the transfer resistance of the particle chains 310 in the solvent 320 according to the present invention may be implemented by the content disclosed in Korea Patent Application Publication No. 10-2012-0010147, filed and published by the applicant of the present invention, the entire content of which is hereby incorporated in the present disclosure by reference.

Meanwhile, although not illustrated in FIGS. 3A to 3C, according to an embodiment of the present invention, a plurality of particles may have electric charges in the same polarity on the surface, and the device for displaying may further include an electric field application unit (not illustrated) that performs the function of applying an electric field to a plurality of particle chains with electric charges. According to an embodiment of the present invention, the electric field application unit (not illustrated) applies the electric field to a plurality of particle chains, and thus at least a part of the plurality of particle chains may move in a direction close to or away from the display surface in the area to which electric field is applied. Accordingly, the intensity of the color displayed in the display surface can be adjusted.

In addition, according to an embodiment of the present invention, the device for displaying may further include a touch sensor unit (not illustrated) provided on the display surface, and the application pattern of the electric field applied by the electric field application unit (not illustrated) with reference to signals input from the touch sensor unit (not illustrated). Accordingly, the intensity of the color displayed on the display surface can be adjusted in accordance with the touch input of the user.

In addition, according to an embodiment of the present invention, the device for displaying may further include an information converting unit (not illustrated) performing a function of converting information on the color displayed on the display surface to another computer-readable type of information by using the optical scanning technique.

Further, with reference to FIGS. 4A to 4C, the particle chains 410 which have been moved in a direction close to the display surface may be irregularly arranged according to the change of at least one of a strength, a direction, an application time, an application speed, and a pattern of lines of magnetic force of the second magnetic field that is applied to the plurality of particle chains 410 in the device for displaying according to an embodiment of the present invention. Accordingly, the intensity of the color of the particle chains 410 that is displayed on the display surface 440 may be lowered or the color of the particle chains 410 themselves may not be displayed.

To be more specific, if the speed of changing at least one of a strength, a direction, an application time, an application speed, and a pattern of lines of magnetic force of the second magnetic field is faster than the speed of moving and stabilizing the particle chains 410, the particle chains 410 concentratively arranged in a direction close to the display surface can be irregularly arranged. Accordingly, the intensity of the color displayed through the display surface may be decreased, so that information can be partially erased only to an area of the display surface in which the at least one of the strength, the direction, the application time, the application speed, and the pattern of lines of magnetic force of the second magnetic field changes.

According to an embodiment of the present invention, a second magnetic field application unit 430 which applies the second magnetic field to the plurality of particle chains 410 may include a special configuration required for changing, only in a desired area, at least one of a strength, a direction, an application time, an application speed, and a pattern of lines of magnetic force of the second magnetic field. A detailed description with respect to the configuration of the second magnetic field application unit 430 will be described below.

Subsequently, with reference to FIGS. 5A to 5C, as a third magnetic field in an opposite direction of the second magnetic field is applied to a plurality of particle chains 510 in the device for displaying according to an embodiment of the present invention, the plurality of particle chains 510 in an area to which the third magnetic field is applied can move in a direction away from the display surface 540, so that the intensity of the color displayed through the display surface can be decreased. Accordingly, among the information displayed through the device for displaying, information displayed through an area, to which the third magnetic field is applied, can be deleted. If the third magnetic field is applied to the entire area of all the particle chains 510 in the device for displaying by the third magnetic field application unit 530, all information displayed on the device for displaying may be erased in a lump (that is, may be reset).

Meanwhile, according to an embodiment of the present invention, films including the display surface may be configured in a form of a scroll made of flexible materials, and the third magnetic field application unit may be disposed in a certain position on the display surface. Accordingly, according to an embodiment of the present invention, if the display surface is rolled or unrolled like a scroll is rolled or unrolled, the intensity of a certain color displayed in an area that is positioned in a certain distance from the third magnetic field application unit in the display surface may be decreased. That is, according to an embodiment of the present invention, only by performing rolling or unrolling of the display surface, information displayed on the display surface can be erased. Meanwhile, according to an embodiment of the present invention, a member functioning as a cushion may be further included under the scroll-shaped film, thereby minimizing the damage of the film when a user performs writing or erasing with respect to the film.

Meanwhile, FIGS. 6A to 7B are diagrams illustrating exemplary configurations for adjusting light intensity according to an embodiment of the present invention.

First, with reference to FIGS. 6A and 6B, if the distance between a second magnetic field application unit 630 and particle chains 610 is relatively close so that the strength of the second magnetic field applied to the particle chains 610 is relatively great, the particle chains 610 existing in an area, to which the second magnetic field is applied, move to a position very close to the display surface, and thus are concentratively arranged around the display surface 640 (see FIG. 6B). Accordingly, the intensity of the color displayed through the display surface of the device for displaying may be relatively increased (see FIG. 6A).

Subsequently, with reference to FIGS. 7A and 7B, when a distance between a second magnetic field application unit 730 and particle chains 710 is relatively long so that the strength of a second magnetic field applied to the particle chains 710 is relatively small, the particle chains 710 existing in an area, to which the second magnetic field is applied, move in a direction close to the display surface 740, but the movement degree and the concentration degree of the arrangement may not be relatively high (see FIG. 7B). Accordingly, the intensity of the color displayed through the display surface of the device for displaying may be relatively decreased (see FIG. 7A).

Meanwhile, FIGS. 6A to 7B illustrate the embodiment of adjusting the light intensity of the device for displaying by adjusting the strength of the second magnetic field, but the configuration relating to the light intensity adjustment according to the present invention is not limited thereto.

In addition, according to an embodiment of the present invention, the intensity of the color displayed through the display surface of the device for displaying or an extent (that is, size) of the area on which the color is displayed can be adjusted by adjusting the extent of the area to which the second magnetic field is applied.

As another example, by adjusting the alignment direction of particle chains that can be aligned in a direction parallel to the direction of the second magnetic field, the transmittance of the light entering the particle chains is changed to adjust the intensity. To be more specific, if the alignment direction of the particle chains is parallel to the direction of the incident light (that is, the direction is perpendicular to the display surface), the degree that the incident light is reflected or scattered by the particle chains is relatively low so that the transmittance of the incident light may be relatively high, and thus the intensity of the color by the particle chains may be decreased. However, if the alignment direction of the particles 310 and 410 is not parallel to the direction of the incident light and form a certain angle, especially a right angle (that is, horizontal angle with respect to the display surface), the degree that the incident light is reflected or scattered by the particle chains is relatively high so that the transmittance of the incident light may be relatively low, and thus the intensity of the color by the particle chains may be increased.

As another example, by adjusting a time for applying the second magnetic field, the degree for moving the particle chains is adjusted, and thus the intensity of the color by the particle chains may be adjusted. That is, the longer the time for applying the second magnetic field, the closer the particle chains move to the display surface, and thus the intensity of the color of the particle chains may be increased.

Meanwhile, FIGS. 8A to 10B are diagrams illustrating exemplary configurations for displaying various colors according to an embodiment of the present invention. In FIGS. 8A to 10B, the device for displaying according to an embodiment of the present invention may include at least two kinds of particle chains composed of at least two kinds of particles with different saturation magnetization values and different colors, and the different kinds of particle chains may show different movement aspects as the second magnetic field is applied.

First, with reference to FIGS. 8A and 8B, the device for displaying may include first particle chain 812, second particle chain 814 and third particle chain 816 with different saturation magnetization values and different colors. According to an embodiment of the present invention, if a distance between a second magnetic field application unit 830 and particle chains 812, 814, and 816 is relatively long so that the strength of the second magnetic field applied to the particle chains 812, 814, and 816 is relatively small, only the first particle chain 812 can move in a direction close to the display surface 840, and thus only the color of the first particle chain 812 can be displayed through the display surface.

Subsequently, with reference to FIGS. 9A and 9B, if a distance between a second magnetic field application unit 930 and particle chains 912, 914, and 916 is closer than in the case of FIGS. 8A and 8B so that the strength of the second magnetic field applied to the particle chains 912, 914, and 916 is greater than in the case of FIGS. 8A and 8B, not only first particle chain 912 but also second particle chain 914 may move in a direction close to the display surface 940, and thus the color of the first particle chain 912 and the color of the second particle chain 914 are mixed and displayed through the display surface.

Subsequently, with reference to FIGS. 10A and 10B, if a distance between a second magnetic field application unit 1030 and particle chains 1012, 1014, and 1016 is closer than in the case of FIGS. 9A and 9B so that the strength of the second magnetic field applied to the particle chains 1012, 1014, and 1016 is greater than in the case of FIGS. 9A and 9B, not only the first particle chain 1012 and the second particle chain 1014 but also the third particle chain 1016 may move in a direction close to the display surface 1040, and thus the color of the first particle chain 1012, the color of the second particle chain 1014 and the color of the third particle chain 1016 are mixed together and displayed through the display surface.

FIGS. 11A to 13B are diagrams illustrating exemplary configurations of the device for displaying in a stacked structure according to an embodiment of the present invention. In FIGS. 11A to 13B, the device for displaying according to an embodiment of the present invention may include vertically stacked at least two cells 1150, 1160, 1170, 1250, 1260, 1270, 1350, 1360, and 1370, each of which includes at least two kinds of particle chains composed of at least two kinds of particles with different colors. The different kinds of particle chains included in each cell may show different aspects as the second magnetic field is applied.

First, with reference to FIGS. 11A and 11B, in the device for displaying, first particle chain 1112, second particle chain 1114, and third particle chain 1116 with different colors may be included in each of three vertically stacked cells 1150, 1160, and 1170. According to an embodiment of the present invention, if a distance between a second magnetic field application unit 1130 and particle chains 1112, 1114, and 1116 is relatively long, so that the strength of the second magnetic field applied to the particle chains 1112, 1114, and 1116 is relatively small, only the first particle chain 1112 positioned at a position most close to the second magnetic field application unit 1130 may move in a direction close to the display surface 1140, and thus only the color of the first particle chain 1112 may be displayed through the display surface.

Subsequently, with reference to FIGS. 12A and 12B, if a distance between a second magnetic field application unit 1230 and particle chains 1212, 1214, and 1216 is closer than in the case of FIGS. 8A and 8B so that the strength of the second magnetic field applied to the particle chains 1212, 1214, and 1216 is stronger than in the case of FIGS. 11A and 11B, not only first particle chain 1212 but also second particle chain 1214 may move in a direction close to the display surface 1240, and thus the color of the first particle chain 1212 and the color of the second particle chain 1214 are mixed and displayed through the display surface.

Subsequently, with reference to FIGS. 13A and 13B, if a distance between a second magnetic field application unit 1330 and particle chains 1312, 1314, and 1316 is closer than in the case of FIGS. 10A and 10B so that the strength of the second magnetic field applied to the particle chains 1312, 1314, and 1316 is stronger than in the case of FIGS. 10A and 10B, not only first particle chain 1312 and second particle chain 1314 but also third particle chain 1316 may move in a direction close to the display surface 1340, and thus the color of the first particle chain 1312, the color of the second particle chain 1314, and the color of the third particle chain 1316 are mixed together and displayed through the display surface.

In FIGS. 2A to 13B described above, only an embodiment in which a plurality of particles form a chain in a straight shape by the first magnetic field is described, but the configuration relating to the alignment form of the particles according to the present invention is not limited thereto, and a plurality of particles may interact to form various shapes including a composite chain shape.

Meanwhile, FIGS. 14A and 14B are diagrams illustrating exemplary configurations of a second magnetic field application unit according to an embodiment of the present invention.

With reference to FIGS. 14A and 14B, a second magnetic field application unit 1430 according to an embodiment of the present invention may include a magnetic field generating unit 1410 and a magnetic field blocking unit 1420. The magnetic field generating unit 1410 includes a permanent magnet or an electromagnet to perform a function of generating a second electric field. In addition, the magnetic field blocking unit 1420 includes a material that can block a magnetic field, and is configured in a form of surrounding the side surface of the magnetic field generating unit 1410. Accordingly, the magnetic field blocking unit 1420 may perform a function in which the second magnetic field generated from the magnetic field generating unit 1410 can be locally applied in a certain direction.

In addition, according to an embodiment of the present invention, the second magnetic field application unit 1430 and the magnetic field generating unit 1410 are configured in an elevatable or height-adjustable manner, or in a manner that the strength of the magnetic field generated by the magnetic field generating unit 1410 can be changed so that the strength of the second magnetic field applied to the particle chains can be adjusted. In addition, according to an embodiment of the present invention, the magnetic field generating unit 1410 of the second magnetic field application unit 1430 are vibratably or rotatably configured so that the strength or the direction of the second magnetic field applied to the particle chains can be changed.

Result of Experiment

A result of an experiment on manufacturing of a film that actually configures the device for displaying using magnetic particles according to an embodiment of the present invention will be described as follows.

First Embodiment (1) Manufacturing of Magnetic Particles

First, iron oxide particles are dispersed in toluene to laminate the iron oxide particles with polymer resin. The polymer resin used for the lamination is a styrene-acrylonitrile (SAN) resin, and the SAN resin is mixed with a toluene solvent and stirred to make a liquid SAN resin solution. An iron oxide particle solution that is dispersed in advance is put into the liquid SAN resin and stirred. After a reaction is completed, in a state that the iron oxide particles are captured by a magnet, the remaining solution is removed and precipitated iron oxide particles are dried.

(2) Manufacturing of Core Material Dispersion Liquid

The iron oxide particles laminated with SAN resins as described above are dispersed in a TCE (tetrachloroethylene) solvent. At this point, in order to increase the miscibility of the iron particles and the solvent, nonionic polymer additives are added and stirred to ensure the dispersibility. After that, the iron oxide particles dispersed in the TCE solvent and white paint are further stirred.

(3) Manufacturing Barrier Material Dispersion Liquid

*Acacia* gum (gum arabic) used as a barrier material is dissolved in water in advance, and then insoluble materials are removed from the mixture by centrifugal filtration. Further, in a state that water is heated to 50° C. or higher, gelatin is added and the *acacia* gum (gum arabic) solution that is prepared in advance is added to manufacture a barrier material dispersion liquid.

(4) Encapsulation

While stirring a reactor, a core material dispersion liquid is put into the barrier material dispersion liquid that is manufactured in advance and emulsified. After the prepared emulsion is stabilized by lowering pH by adding an acetic acid solution to the emulsion, the emulsion is cooled. A water soluble curing solution is added to the emulsion, heated, and stirred at room temperature. Then, capsules are sunk, washed with water, and gathered.

(5) Manufacturing of Films

The washed capsules and a binder are mixed in a roller. When capsule layers are all sunk, an upper transparent liquid portion is thrown away in order to complete slurry for manufacturing films. After fixing a PET (polyethylene telephthalate) film on a bar coater, the capsule slurry that is manufactured in advance is applied on the film. After drying the slurry, the upper surface of the PET film is laminated by using a laminator, and thus the film is finally completed.

Second Embodiment (1) Manufacturing of Core Material Dispersion Liquid

In order to increase the miscibility of iron oxide particles and a solvent, nonionic polymer additives are added to a TCE (tetrachloroethylene) solvent and stirred. Thereafter, iron oxide particles are added and further stirred. White paint is added to the solution in which the iron oxide particles are dispersed, and then mixed by using a roller so that the resultant is well mixed.

(2) Manufacturing of Barrier Material Dispersion Liquid

*Acacia* gum (gum arabic) used as a barrier material is dissolved in water in advance, and then insoluble materials are removed from the mixture by centrifugal filtration. Further, when water is heated to 50° C. or higher, gelatin is added, and the *acacia* gum (gum arabic) solution that is prepared in advance is added to manufacture a barrier material dispersion liquid.

(3) Encapsulation

While stirring a reactor, a core material dispersion liquid is put into the barrier material dispersion liquid that is manufactured in advance and emulsified. After the prepared emulsion is stabilized by lowering pH by adding an acetic acid solution to the emulsion, the emulsion is cooled. A water soluble curing solution is added to the emulsion, heated to room temperature, and stirred at room temperature. Then, capsules are immersed, washed with water, and gathered.

(4) Manufacturing of Films

The washed capsules and a binder are mixed in a roller. When capsule layers are all sunk, an upper transparent liquid portion is thrown away in order to complete slurry for manufacturing films. After fixing a PET (polyethylene telephthalate) film on a bar coater, the capsule slurry that is manufactured in advance is applied on the film. After drying the slurry, the upper surface of the PET film is laminated by using a laminator, and thus the film is finally completed.

Third Embodiment (1) Manufacturing Core Material Dispersion Liquid

A TCE (tetrachloroethylene) solvent and a toluene solvent are mixed. In order to increase the miscibility of particles and a solvent, a dispersing agent is added and stirred. Thereafter, titania ($TiO_2$) particles and iron oxide particles are respectively put into the mixed solvent, and then stirred for an hour to be dispersed. Paint is added to the well dispersed titania ($TiO_2$) particle solution. The resultant is well mixed using a roller. Thereafter, the dispersed iron oxide particles are added and mixed using the roller.

(2) Manufacturing of Barrier Material Dispersion Liquid

*Acacia* gum (gum arabic) used as a barrier material is dissolved in water in advance, and then insoluble materials are removed from the mixture by centrifugal filtration. Thereafter, in a state that water is heated to 50° C. or higher, gelatin is added and the *acacia* gum (gum arabic) solution that is prepared in advance is added to manufacture a barrier material dispersion liquid.

(3) Encapsulation

While stirring a reactor, a core material dispersion liquid is put into the barrier material dispersion liquid that is manufactured in advance and emulsified. After the prepared emulsion is stabilized by lowering pH by adding an acetic acid solution to the emulsion, the emulsion is cooled. A curing solution is added to the emulsion, heated to room temperature, and stirred at room temperature. Then, capsules are sunk, washed with water, and gathered.

(4) Manufacturing of Films

The washed capsules and a binder are mixed in a roller. When capsule layers are all sunk, an upper transparent liquid portion is thrown away in order to complete slurry for manufacturing films. After fixing a PET (polyethylene telephthalate) film on a bar coater, the capsule slurry that is manufactured in advance is applied on the film. After drying the slurry, the upper surface of the PET film is laminated by using a laminator, and thus the film is finally completed.

Figure 15:
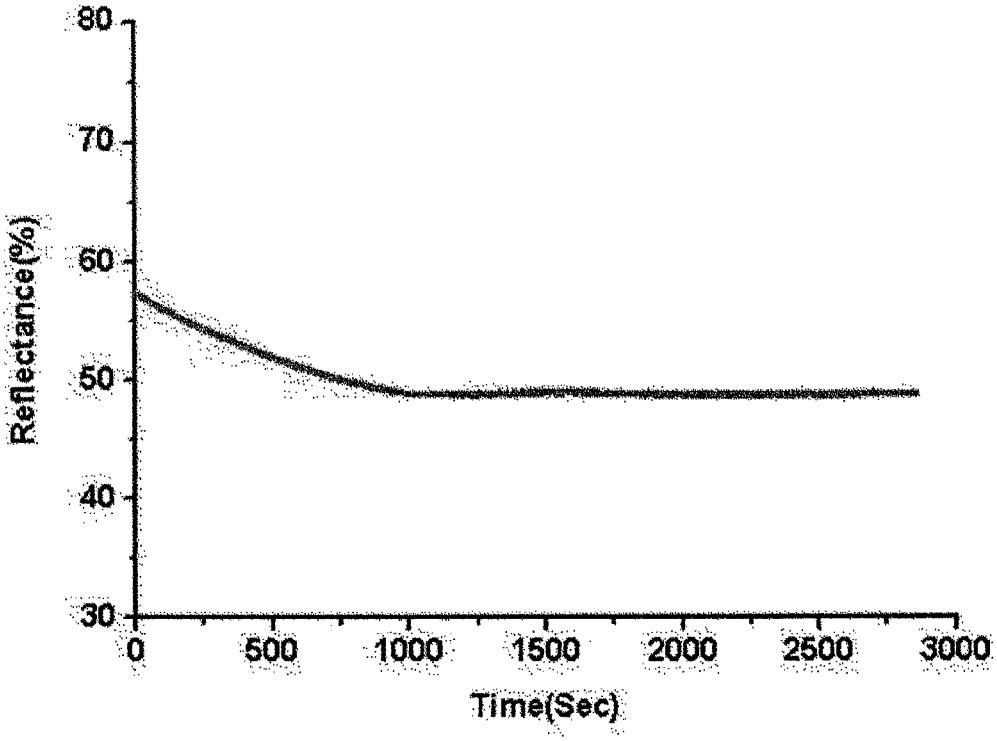
FIGS. 15 and 16 are graphs illustrating experiment results relating to a performance for maintaining a displayed state of a film manufactured according to the second and third embodiments.
Figure 16:
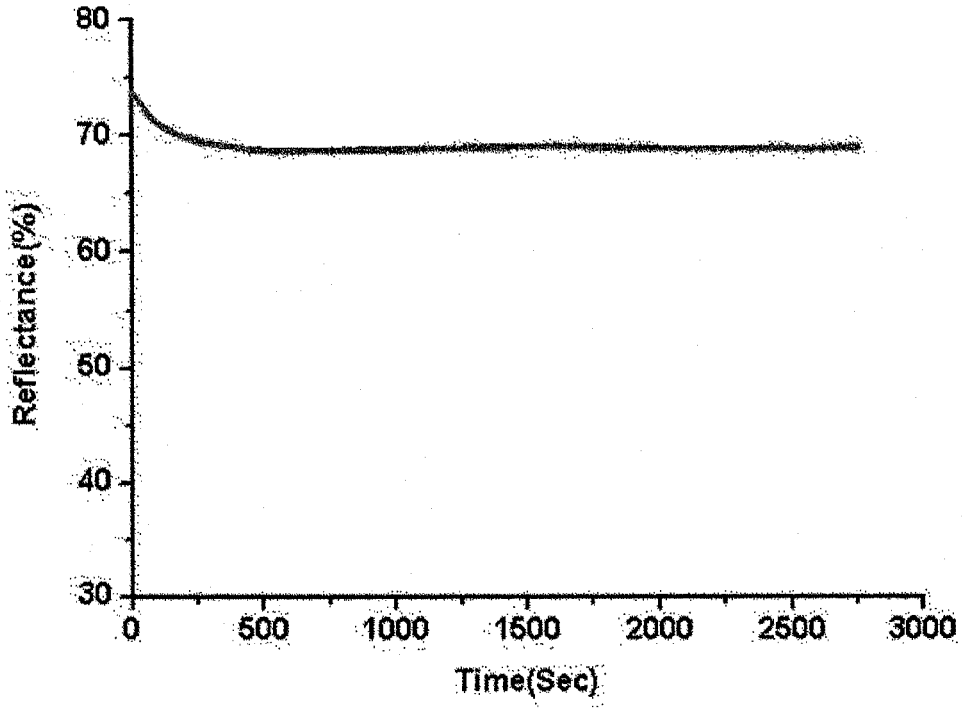

FIGS. 15 and 16 are graphs illustrating experiment results relating to a performance for maintaining a displayed state of a film manufactured according to the second and third embodiments. A change in reflectivity in FIGS. 15 and 16 may mean a change of the displayed state of the film.

With reference to FIGS. 15 and 16, the reflectivity tends to decrease (that is, the displayed state is changed) right after the applied magnetic field is blocked, but as the time passes, the tendency of decreasing the reflectivity is reduced. Especially, it is identified that, from the point when 700 seconds passes after the applied magnetic field is blocked, the reflectivity hardly changes (that is, the displayed state hardly changes). Therefore, it is identified that according to the film according to the present invention, the displayed state generated by particle chains that move in a direction close to the display surface as the magnetic field is applied is stably maintained for a long time after the magnetic field is blocked.

Figure 17:
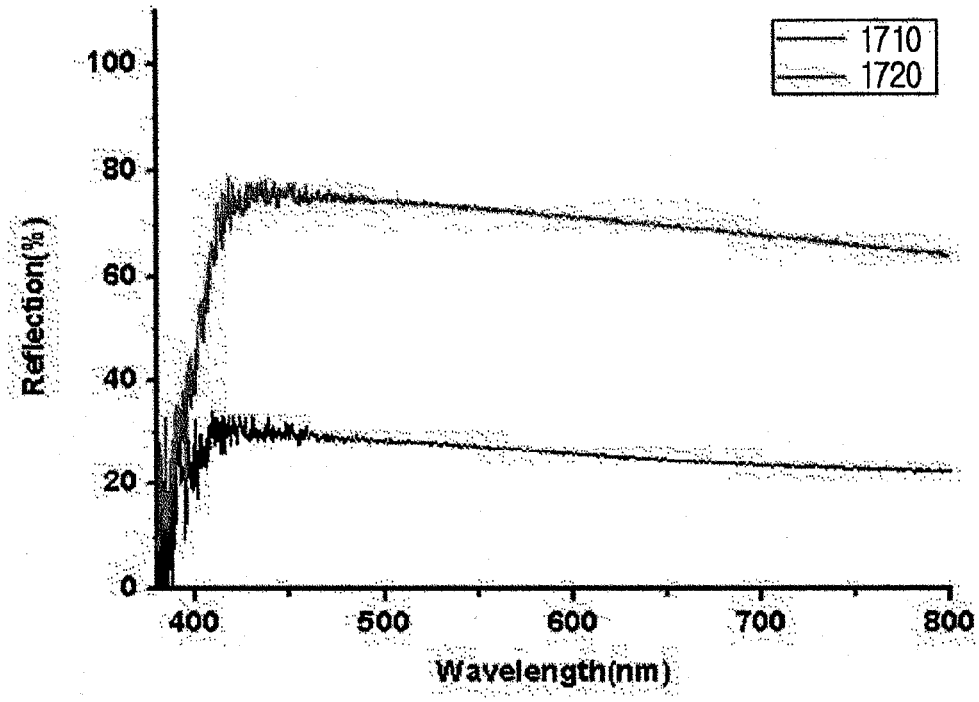
FIG. 17 is a graph illustrating an experiment result with respect to the writing and erasing performance of a film manufactured according to the third embodiment.

FIG. 17 is a graph illustrating an experiment result with respect to the writing and erasing performance of a film manufactured according to the third embodiment. In FIG. 17, a graph 1710 illustrated in a black color corresponds to a graph showing reflectivity according to wavelengths in a case when certain information is displayed by moving particle chains in a direction close to the display surface by applying a second magnetic field to the film (that is, in case of writing), and a graph 1720 illustrated in a red color corresponding to a graph showing reflectivity according to wavelengths in a case when certain information is displayed by moving particle chains in a direction away from the display surface by applying a third magnetic field opposite to the second magnetic field to the film (that is, in case of erasing).

With reference to FIG. 17, it is identified, from the experiment result showing that the reflectivity in case of the writing and the reflectivity in case of the erasing are greatly different from each other, that information displayed through the film may be displayed in a state in which the intensity is high.

The method, film, and the device for displaying according to the present invention as described above may be applied to teaching tools such as a board and a note for education; or to electronics such as a refrigerator, a television, and a notebook, or a device for adjusting the surface color of a furniture such as a table and a chair; or may be utilized as means for adjusting the color of finished and equipped materials for a building such as walls and floors.

As described above, the present invention are described with specified matters such as specific components and limited embodiments and drawings, but these are provided for a general understanding of the present invention. The present invention is not limited to the embodiment described above, and various modifications and changes are possible from the descriptions by a person having ordinary skill in the art to which the subject matter pertains.

Therefore, the idea of the present invention should not be determined in a manner limited to the described embodiments, and it should be understood that the accompanying claims and those equivalent or equivalently modified to the claims belong to the scope of the idea of the present invention.

What is claimed is:

1. A display method using magnetic particles, comprising steps of:

(a) applying a first magnetic field to a plurality of particles in a state where the plurality of particles having a magnetic property and a certain color are dispersed in a solvent so that the plurality of particles are aligned in a direction parallel to a direction of the first magnetic field and a plurality of particle chains are formed; and (b) applying a second magnetic field to at least a part of the formed plurality of particle chains so that at least a part of the plurality of particle chains moves in a direction close to a display surface in an area to which the second magnetic field is applied, and thus the certain color is displayed on the display surface.

2. The display method using magnetic particles according to claim 1, wherein the plurality of particles include ferromagnetic materials, and in step (a), although the first magnetic field is blocked, the plurality of particle chains are maintained by residual magnetic polarity formed in each of the plurality of particles due to the ferromagnetic material.

3. The display method using magnetic particles according to claim 1, wherein in step (b), at least one of a distance between the display surface and the particle chains, which move in the direction close to the display surface in the area to which the second magnetic field is applied, and an angle between the display surface and the particle chains is adjusted by adjusting at least one of a strength, a direction, an application time, an application speed, and a pattern of lines of magnetic force of the second magnetic field, and thus an intensity of the certain color displayed on the display surface is adjusted.

4. The display method using magnetic particles according to claim 1, wherein the plurality of particles include at least two kinds of particles with different saturation magnetization values and different colors, and in step (b), kinds of the particle chains, which move in the direction close to the display surface in the area to which the second magnetic field is applied, vary according to a strength of the second magnetic field, and thus colors displayed on the display surface vary.

5. The display method using magnetic particles according to claim 1, further comprising a step of vertically stacking at least two cells each including at least two kinds of particles with different colors so that kinds of the particle chains, which move in the direction close to the display surface, vary according to a strength of the second magnetic field applied to the at least two cells, and thus colors displayed on the display surface vary.

6. The display method using magnetic particles according to claim 1, further comprising a step of horizontally arranging at least two cells each including at least two kinds of particles with different colors and independently applying the second magnetic field to the at least two cells so that kinds of the particle chains, which move in the direction close to the display surface, are adjusted independently in each of the at least two cells.

7. The display method using magnetic particles according to claim 1, further comprising a step of adjusting transfer resistance of the plurality of particle chains in the solvent so that after the second magnetic field is blocked in step (b), an arrangement state of the particle chains, which move in the direction close to the display surface in the area to which the second magnetic field is applied, is maintained in a certain range for a certain period of time or more.

8. The display method using magnetic particles according to claim 1, further comprising a step of adjusting transfer resistance of the plurality of particle chains in the solvent by adjusting at least one of a viscosity of the solvent, a specific gravity of the solvent, a specific gravity of the particles, or adding an additive to the solvent.

9. The display method using magnetic particles according to claim 1, further comprising a step of:

(c1) changing at least one of a direction, a strength, an application time, an application speed, and a pattern of lines of magnetic force of the second magnetic field on the display surface so that the particle chains, which move in the direction close to the display surface in the area to which the second magnetic field is applied in step (b), are irregularly arranged, and thus an intensity of the certain color is decreased only in an area where the change is performed in the display surface.

10. The display method using magnetic particles according to claim 1, further comprising a step of:

(c2) applying a third magnetic field so that the plurality of particle chains move in a direction away from the display surface, and thus an intensity of the certain color displayed in the display surface is decreased.

11. The display method using magnetic particles according to claim 1, wherein the plurality of particles and the solvent are encapsulated by a light permeable medium and processed into a film shape.

12. The display method using magnetic particles according to claim 1, wherein the plurality of particles have electric charges with the same polarity, and in step (b), an electric field is further applied so that at least a part of the plurality of particle chains moves in a direction close to a display surface in an area to which the electric field is applied or in a direction away from the display surface, and thus an intensity of the certain color displayed on the display surface is adjusted.

13. The display method using magnetic particles according to claim 12, wherein in step (b), the intensity of the certain color displayed on the display surface is adjusted by adjusting a pattern of the electric field with reference to a signal input from a touch sensor provided on the display surface.

14. The display method using magnetic particles according to claim 1, further comprising a step of:

(d) converting information on the certain color displayed on the display surface into information of computer-readable form by using an optical scanning technique.

15. A display device using magnetic particles, comprising:

a plurality of particles having a magnetic property and a certain color;

a solvent in which the plurality of particles are dispersed;

a first magnetic field application unit that applies a first magnetic field to the particles and the solvent; and a second magnetic field application unit that applies a second magnetic field to the particles and the solvent, wherein the first magnetic field application unit applies the first magnetic field to the plurality of particles in a state where the plurality of particles are dispersed in the solvent so that the plurality of particles are aligned in a direction parallel to a direction of the first magnetic field and the plurality of particle chains are formed, and the second magnetic field application unit applies a second magnetic field to at least a part of the formed plurality of particle chains so that at least a part of the plurality of particle chains moves in a direction close to a display surface in an area to which the second magnetic field is applied, and thus the certain color is displayed on the display surface.

* * * * *